US008250788B2

(12) United States Patent
Scheve et al.

(10) Patent No.: US 8,250,788 B2
(45) Date of Patent: Aug. 28, 2012

(54) LINEN PROCESSING APPARATUS INCLUDING A DEVICE FOR CONTROLLING THE WATER FLOW SUPPLIED TO A STEAM GENERATOR

(75) Inventors: Björn Scheve, Reichelsheim (DE); Matthias Hahn, Frankfurt (DE)

(73) Assignee: Rowenta Werke GmbH, Offenbach (DE)

( * ) Notice: Subject to any disclaimer, the term of this patent is extended or adjusted under 35 U.S.C. 154(b) by 504 days.

(21) Appl. No.: 12/599,087

(22) PCT Filed: Apr. 21, 2008

(86) PCT No.: PCT/IB2008/001056

§ 371 (c)(1),
(2), (4) Date: Nov. 6, 2009

(87) PCT Pub. No.: WO2008/135827

PCT Pub. Date: Nov. 13, 2008

(65) Prior Publication Data

US 2010/0299974 A1 Dec. 2, 2010

(30) Foreign Application Priority Data

May 7, 2007 (FR) ..... 07 03269

(51) Int. Cl.
*D06F 75/18* (2006.01)
*F16L 11/00* (2006.01)

(52) U.S. Cl. ..... 38/77.8; 138/118; 251/7

(58) Field of Classification Search ..... 38/74–77.9; 251/4–10; 137/803, 825, 829, 832; 138/118, 138/119

See application file for complete search history.

(56) References Cited

U.S. PATENT DOCUMENTS

| | | | | |
|---|---|---|---|---|
| 2,931,387 | A * | 4/1960 | Fleming | 137/883 |
| 3,869,816 | A * | 3/1975 | Busby | 38/77.83 |
| 3,921,648 | A * | 11/1975 | Barradas | 132/228 |
| 4,135,448 | A | 1/1979 | Moestue | |
| 4,837,952 | A * | 6/1989 | Hennuy et al. | 38/77.7 |
| 5,810,324 | A * | 9/1998 | Eriksson et al. | 251/7 |
| 5,826,621 | A * | 10/1998 | Jemmott | 137/853 |
| 6,055,907 | A | 5/2000 | Endisch et al. | |
| 6,494,864 | B1 * | 12/2002 | Kerwin et al. | 604/131 |
| 6,748,680 | B2 * | 6/2004 | Pahlke et al. | 38/77.8 |
| 7,976,513 | B2 * | 7/2011 | Cise et al. | 604/246 |

FOREIGN PATENT DOCUMENTS

| | | | |
|---|---|---|---|
| DE | 102004023032 | A1 | 12/2004 |
| EP | 0849521 | A1 * | 6/1998 |
| GB | 2328903 | A | 3/1999 |

* cited by examiner

*Primary Examiner* — Ismael Izaguirre

(74) *Attorney, Agent, or Firm* — Browdy and Neimark, PLLC

(57) ABSTRACT

Appliance for the treatment of fabric articles comprising a water tank, a steam generator for diffusing steam in the direction of the fabric article and a water supply circuit of the steam generator comprising an electric pump, characterized in that said supply circuit comprises a flexible tube (12) and a device (13) for adjusting the flow of water sent to the steam generator comprising means (133) for compressing the flexible tube (12) so as to modify its cross-section of flow.

17 Claims, 4 Drawing Sheets

LINEN PROCESSING APPARATUS INCLUDING A DEVICE FOR CONTROLLING THE WATER FLOW SUPPLIED TO A STEAM GENERATOR

The present invention relates to an appliance for the treatment of fabric articles comprising a water tank and a steam generator supplied with water from the tank by an electric pump, and more specifically relates to an appliance comprising a device for adjusting the flow of liquid sent to the steam generator.

There is a steam producing appliance known from the document DE 102004023032 comprising a tank and an electric pump for sending water to a steam generator, the supply circuit of the generator comprising a bifurcation that makes it possible to return part of the water delivered by the pump back to the tank in order to control the quantity of water sent to the generator. In that document, it is indicated that the conduit can be equipped with a device for adjusting the flow of liquid passing through the bifurcation. However, that document does not disclose the means used to adjust the flow of liquid passing through the conduit.

Thus, one object of the present invention is to propose a steaming appliance for the treatment of fabric articles comprising a steam generator supplied with water by an electric pump and a device for adjusting the flow of liquid sent to the steam generator that is simple and economical to produce. Another object of the present invention is to propose a device for adjusting the flow of liquid inside a flexible tube that makes it possible to adjust the flow gradually and that is reliable over time.

To this end, the subject of the invention is an appliance for the treatment of fabric articles comprising a water tank, a steam generator for diffusing steam in the direction of the fabric article, and a water supply circuit of the steam generator comprising an electric pump, characterized in that the supply circuit comprises a flexible tube and a device for adjusting the flow of water sent to the steam generator comprising means for compressing the flexible tube so as to modify its cross-section of flow.

According to another feature of the invention, the device for adjusting the flow comprises several filaments of small cross-section extending inside the flexible tube at the height of the means for compressing the tube.

According to another feature of the invention, the flexible tube contains at least ten filaments.

According to another feature of the invention, the filaments are made of plastic material.

According to yet another feature of the invention, the filaments are made of polyamide.

According to another feature of the invention, the means for compressing the conduit comprise an articulated lever actuated by a rotating cam.

According to yet another feature of the invention, the electric pump comprises an inlet opening connected by a first conduit to the water tank and a discharge opening connected by a second conduit to a junction comprising a first branch connected to the steam generator and a second branch connected to the water tank, the second branch comprising the flow adjusting device.

According to another feature of the invention, the appliance is a handheld steam brush.

The invention also relates to a device for controlling the flow of liquid passing through a flexible tube wherein means locally compress the flexible tube so as to reduce its cross-section of flow, characterized in that the device comprises several filaments of small cross-section extending inside the flexible tube at the height of the means for compressing the tube.

According to another feature of the invention, the interior volume of the flexible tube contains at least ten filaments.

According to another feature of the invention, the filaments are made of plastic material.

According to another feature of the invention, the filaments are made of polyamide.

The objects, aspects and advantages of the present invention will be more clearly understood based on the description given below of a particular embodiment of the invention presented as a nonlimiting example, in reference to the attached drawings, in which.

Only the elements required to understand the invention have been illustrated. To facilitate the reading of the drawings, the same elements have the same references from one figure to another.

Figure 1:
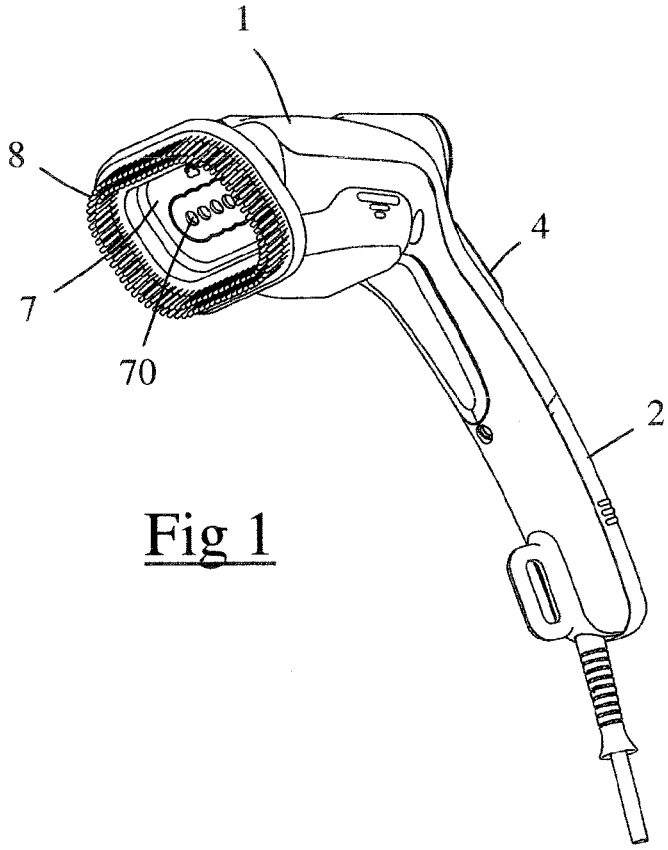
FIGS. 1 and 2 are perspective views of a steam brush according to a particular embodiment of the invention.
Figure 2:
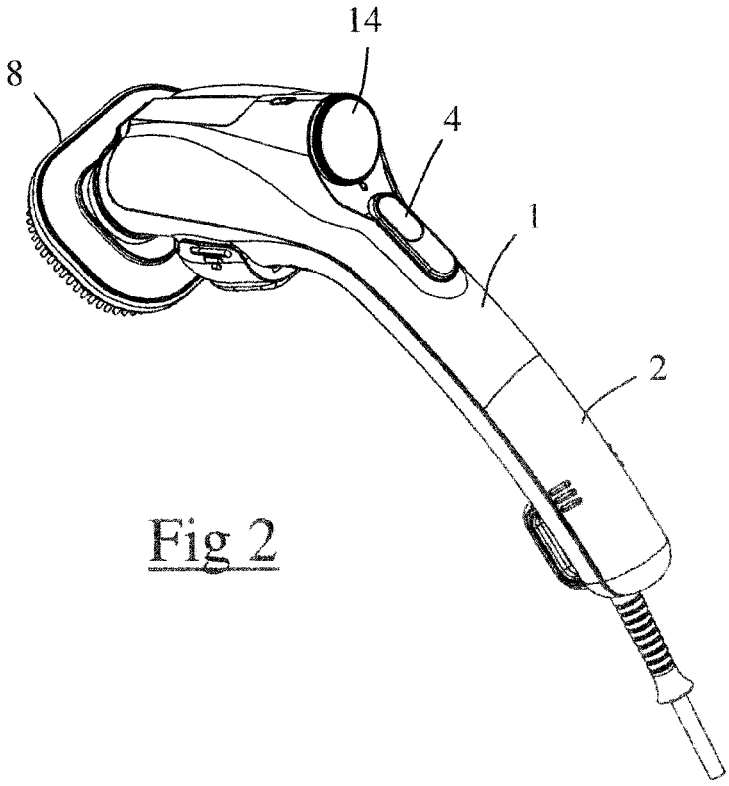
Figure 3:
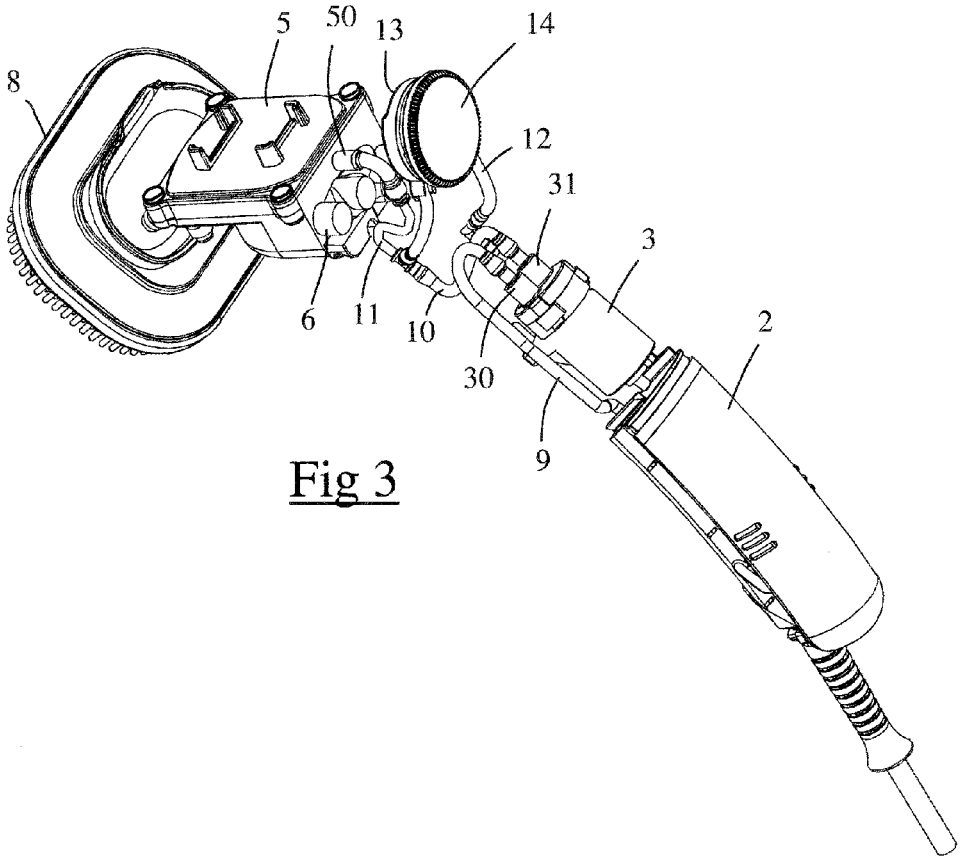
FIG. 3 is a perspective view of the appliance of FIGS. 1 and 2 with its outer shell removed.

FIGS. 1 through 3 illustrate a steaming appliance comprising a plastic shell 1 comprising an elongated part forming a handle which receives a removable water tank 2 whose top wall constitutes the top part of the handle. The elongated part of the shell 1 also encloses an electric pump 3, visible in FIG. 3, which is actuated by a control button 4. The shell 1 comprises, in the extension of the handle, a wider part which encloses a steam generator 5, visible in FIG. 3, conventionally constituted by an instant steam production chamber associated with an electric heating element 6.

The shell 1 of the appliance is closed, on the opposite end from the handle, by a flat surface 7 comprising steam outlet holes 70, the shell 1 advantageously receiving a removable brush 8 comprising multiple flexible bristles running along the periphery of the flat surface 7 and allowing traction to be applied to the fibers as steam is diffused through holes 70 in order to promote wrinkle removal.

Figure 4:
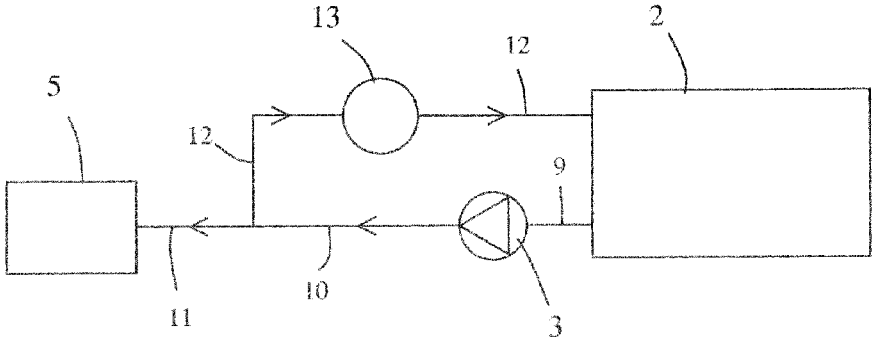
FIG. 4 is a schematic illustration of the water supply circuit of the steam generator of the appliance in FIGS. 1 and 2.

According to FIG. 3, the electric pump 3 comprises an inlet opening 30 connected by a conduit 9 to the tank 2 and comprises a discharge opening 31 which sends the water from the tank 2 through a supply circuit of the steam generator 5, schematically illustrated in FIG. 4, comprising a conduit 10 leading to a junction that divides the supply circuit into a first conduit branch 11 connected to an inlet opening 50 of the steam generator 5 and a second conduit branch 12 connected to the tank 2 allowing part of the water from the pump 3 to be returned to the tank 3.

Preferably, the first conduit branch 11 has a smaller cross-section of flow than the second conduit branch 12, the first conduit branch having for example an internal diameter on the order of 1 mm and the second conduit branch 12 having for example an internal diameter on the order of 2 mm.

More specifically according to the invention, the second conduit branch is constituted by a flexible tube 12, for example made of rubber, which passes through a cylindrical housing 13 comprising means for compressing the flexible tube 12 so as to reduce the cross-section of flow of the latter and control the quantity of water returned to the tank 2.

Figure 5:
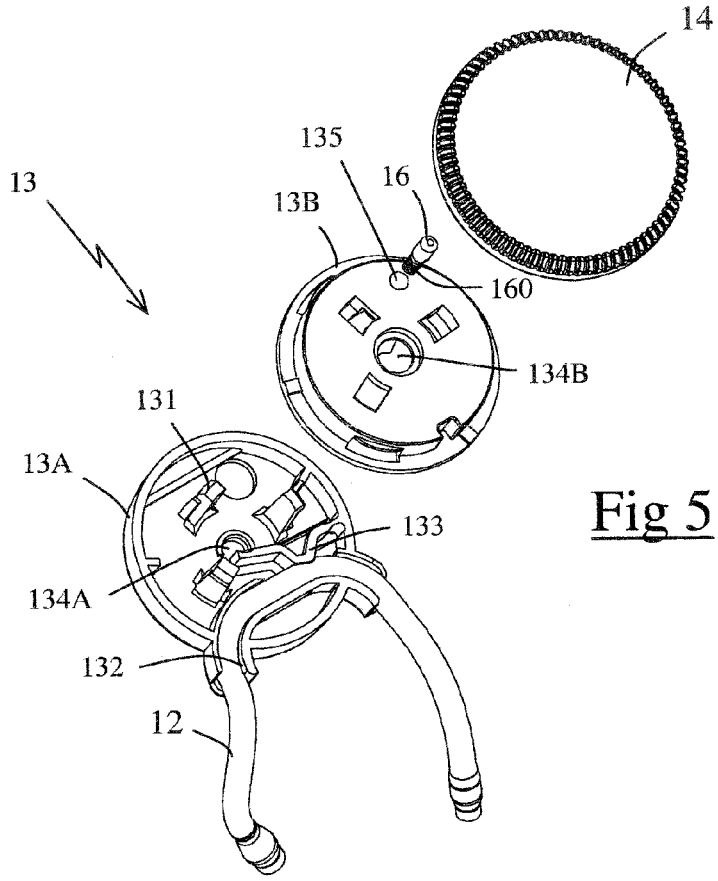
FIGS. 5 and 6 are exploded perspective views of the device for adjusting the flow of liquid with which the appliance of FIGS. 1 and 2 is equipped.
Figure 6:
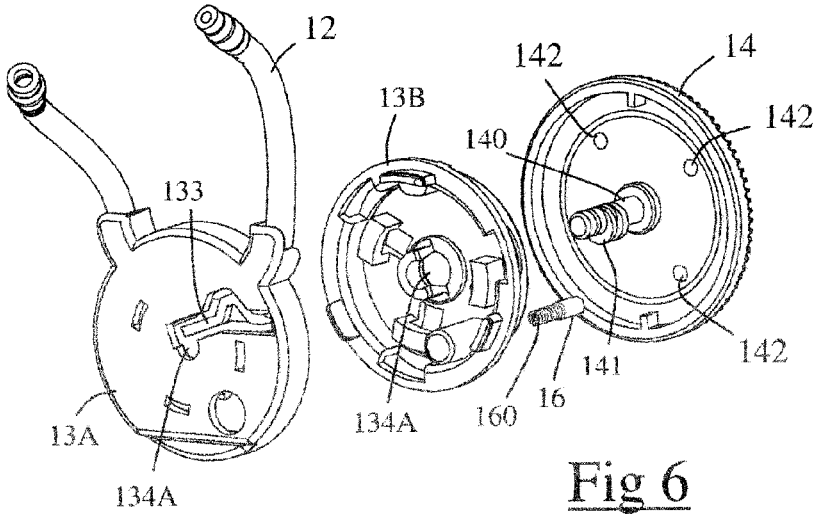
Figure 7:
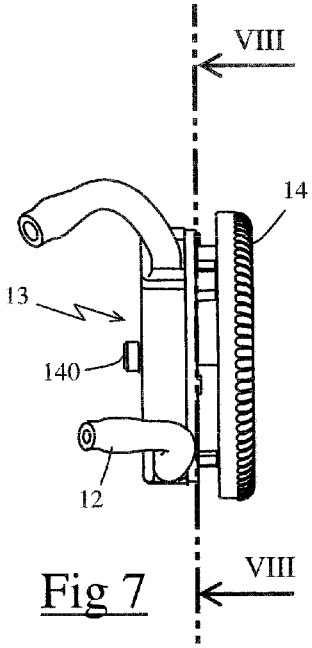
FIG. 7 is a side view of the liquid adjusting device with which the appliance of FIGS. 1 and 2 is equipped.

According to FIGS. 5 and 6, the cylindrical housing 13 is preferably composed of two plastic parts 13A, 13B fastened to each other by means of elastic clips 131, the bottom part 13A of the housing comprising a channel 132 for receiving the flexible tube 12 that has a lateral opening which faces means for compressing the tube 12 constituted by a lever 133 having a bent part that presses against the outer surface of the flexible tube 12.

The lever 133 is advantageously obtained by being directly molded with the bottom part 13A of the cylindrical housing and includes an end that is articulated to the periphery of the housing 13 and a free end that extends near the center of the housing 13. The bottom 13A and top 13B parts of the housing comprise a center opening 134A, 134B which receives the shaft 140 of a rotating knob 14 that covers the top part 13B of the housing while projecting outward from the shell 1 of the appliance, the shaft 140 being equipped with cams 141 which push the lever 133 toward the flexible tube 13 when the shaft 140 is rotated, so that the bent part of the lever 133 compresses the flexible tube 12.

Advantageously, the top part 13B of the housing includes a seat 135 for receiving a locking pin 16 pressed by a spring 160 against the inner surface of the rotating knob 14, the latter having three indentations 142 into which the end of the pin 16 can fit so as to immobilize the knob 14 in three predefined positions, respectively corresponding to a minimum, average and maximum production of steam by the steaming appliance.

As may be seen in FIGS. 8 through 12, the flexible tube 12 contains numerous filaments 15 of circular cross-section and small diameter, preferably on the order of 0.2 mm, extending freely inside the internal diameter of the flexible tube 12, these filaments 15 preferably being made of polyamide material.

Figure 10:
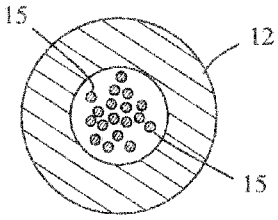
FIGS. 10 through 12 are cross-sections of the flexible tube with which the liquid adjusting device of the preceding figures is equipped, when the adjusting knob is respectively in the minimum steam position, in the maximum steam position and in an intermediate position.
Figure 11:
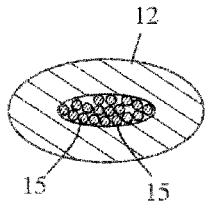
Figure 12:
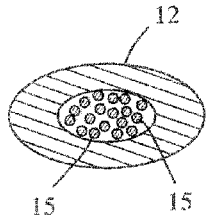

For example, as illustrated in FIGS. 10 through 12, the flexible tube 12 can have an outer diameter on the order of 4 mm for an internal diameter on the order of 2 mm and will contain eighteen filaments 15 having a length similar to the length of the flexible tube 12.

It is understood that the number of filaments 15 inserted into the flexible tube 12 will chiefly depend on the internal diameter of the latter and will advantageously be between ten and twenty-five filaments, the number of filaments 15 preferably being adapted so that the filaments 15 occupy between 10 and 30% of the cross-section of flow of the flexible tube 12 when the latter is not deformed.

The operation of the flow control device of the appliance will now be described.

Figure 8:
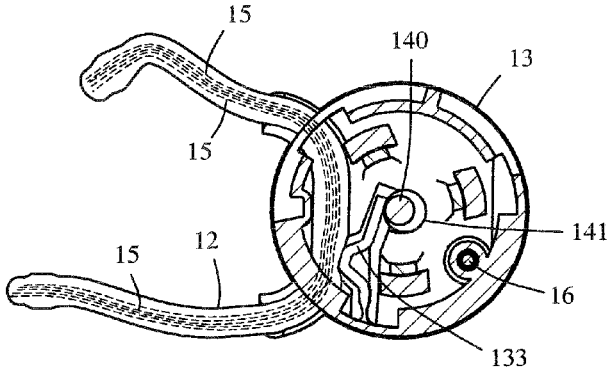
FIGS. 8 and 9 are cross-sectional views along line VIII-VIII of FIG. 7 when the adjusting knob is respectively in the minimum steam production position and the maximum steam production position.
Figure 9:
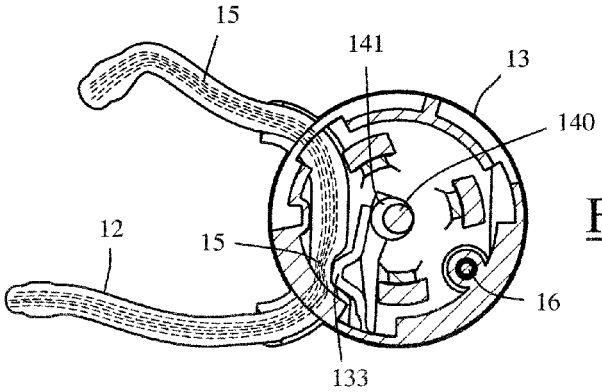

According to FIGS. 8 through 10, when the rotating knob 14 is turned so that the cam 141 is not pushing the lever 133 toward the flexible tube 12, the pressure exerted by the bent part of the lever 133 on the flexible tube 12 is insufficient to deform it, so the internal diameter of the flexible tube 12 is substantially cylindrical and the filaments 15 spread out freely inside the flexible tube 12, leaving open a substantial cross-section of flow, on the order of 2.6 $mm^2$.

In that case, actuating the electric pump 3 by means of the button 4 causes water from the tank 2 to be aspirated through the first conduit 9 and causes water to be discharged through the second conduit 10, the flow of water sent through this second conduit 10 being divided into a first relatively low flow sent through the first branch 11 to the steam generator 5 and a second, more substantial flow of water sent through the flexible tube 12 to the tank as a result of the substantial cross-section of flow left open on either side of the filaments 15.

The steam generator 5 is then supplied with a low flow of water through the first conduit branch 11, which allows the steaming appliance to operate with a low flow of steam.

Conversely, when the user turns the knob 14 so as to bring it into the extreme position illustrated in FIG. 9, the cam 141 incorporated into the knob 14 moves the lever 133 toward the flexible tube 12, which is deformed under the compression exerted by the bent part of the lever 133 so that the cross-section of flow inside the flexible tube 12 is sharply reduced around the filaments 15, as illustrated in FIG. 11. This results in a cross-section of flow in the tube 12 that is essentially limited to the residual space between the filaments 15 of circular cross-section pressed against each other, and hence quite a substantial head loss inside the flexible tube 12, the consequence of which is to send most of the flow of water from the pump 3 through the first conduit branch 11 to the steam generator 5.

The flow of steam emanating through the steam outlet holes 70 is therefore increased, and the appliance produces a maximum flow of steam.

The knob 14 can also be brought into an intermediate position, in which it is locked into position by the cooperation of the pin 16 with the middle indentation 142 of the knob 14. In this position, the squeezing of the flexible tube 12 is such that its height is reduced by half, as illustrated in FIG. 12, and the cross-section of flow through the flexible tube 12 equipped with the filaments 15 becomes on the order of 1 $mm^2$. Such an intermediate position of the knob 14 makes it possible to obtain an average head loss through the flexible tube 12 such that the flow of water sent to the steam generator 5 corresponds to an average flow of steam.

Such a device, in which a flexible tube is pinched in order to modify its cross-section of flow, has the advantage of making it possible to adjust the steam flow of the steaming appliance using a mechanical system that is simple and economical to produce. In particular, such a device makes it possible to modify the flow of steam in the steaming appliance without acting on the electric power supply of the pump.

In addition, the presence of filaments inside the flexible tube has the advantage of allowing a more gradual reduction of the tube's cross-section of flow and hence better control of the flow passing through it. In fact, although it is possible to roughly adjust the flow passing through a flexible tube by compressing the latter when the tube does not contain filaments, such a device has the drawback providing an adjustment that is not very gradual, with the cross-section of flow of the tube being reduced slightly in the first phase of compression of the tube and much more suddenly when the two opposite walls of the tube come into contact with each other.

Finally, the presence of filaments in the flexible tube also has the advantage of preventing the phenomenon of the walls sticking to each other that occurs when the walls of a rubber tube are kept pressed against each other for a long time; the filaments prevent the opposite walls of the flexible tube from coming into contact when the latter is squeezed by the bent part of the lever. Moreover, the circular cross-section of the filaments makes it possible to limit the contact surface of the filaments with each other or with the flexible tube so that the adhesion phenomenon is limited; the use of polyamide material for the filaments also makes it possible to prevent the filaments from remaining stuck to each other.

It is understood that the invention is in no way limited to the embodiment described and illustrated, which has been given only as an example. Modifications are possible, particularly with regard to the composition of the various elements or the substitution of technical equivalents, without going outside the scope of protection of the invention.

The invention claimed is:

1. Appliance for the treatment of fabric articles comprising a water tank (2), a steam generator (5) for diffusing steam in the direction of the fabric article, and a water supply circuit of the steam generator (5) comprising an electric pump (3), said supply circuit comprising a flexible tube (12) and a device (13) for adjusting the flow of water sent to the steam generator comprising means (133) for compressing the flexible tube (12) so as to modify its cross-section of flow, characterized in that the device (13) for adjusting the flow comprises several filaments (15) of small cross-section extending inside the flexible tube (12) at the height of the means (133) for compressing the tube (12).

2. Appliance for the treatment of fabric articles according to claim 1, characterized in that the flexible tube (12) contains at least ten filaments (15).

3. Appliance for the treatment of fabric articles according to claim 2, characterized in that the filaments (15) are made of plastic material.

4. Appliance for the treatment of fabric articles according to claim 3, characterized in that the filaments (15) are made of polyamide.

5. Appliance according to claim 4, characterized in that the means for compressing the conduit comprise an articulated lever (133) actuated by a rotating cam (141).

6. Appliance according to claim 5, characterized in that said electric pump (3) comprises an inlet opening (30) connected by a first conduit (9) to the water tank (2) and a discharge opening (31) connected by a second conduit (10) to a junction comprising a first branch (11) connected to the steam generator and a second branch (12) connected to the water tank (2), said second branch (12) comprising said flow adjusting device (13).

7. Appliance according to claim 6, characterized in that the appliance is a handheld steam brush.

8. Appliance according to claim 6, characterized in that the appliance is a handheld steam brush.

9. Appliance for the treatment of fabric articles according to claim 1, characterized in that the filaments (15) are made of plastic material.

10. Appliance according to claim 1, characterized in that the means for compressing the conduit comprise an articulated lever (133) actuated by a rotating cam (141).

11. Appliance according to claim 1, characterized in that said electric pump (3) comprises an inlet opening (30) connected by a first conduit (9) to the water tank (2) and a discharge opening (31) connected by a second conduit (10) to a junction comprising a first branch (11) connected to the steam generator and a second branch (12) connected to the water tank (2), said second branch (12) comprising said flow adjusting device (13).

12. Device (13) for controlling the flow of liquid passing through a flexible tube (12) wherein means (133) locally compress the flexible tube (12) so as to reduce its cross-section of flow, characterized in that said device (13) comprises several filaments (15) of small cross-section extending inside the flexible tube (12) at the height of the means (133) for compressing the tube (12).

13. Device according to claim 12, characterized in that the interior volume of the flexible tube (12) contains at least ten filaments (15).

14. Device according to claim 13, characterized in that the filaments (15) are made of plastic material.

15. Device according to claim 14, characterized in that the filaments (15) are made of polyamide.

16. Device according to claim 12, characterized in that the filaments (15) are made of plastic material.

17. Device according to claim 16, characterized in that the filaments (15) are made of polyamide.

* * * * *